US011167438B2

(12) United States Patent
Ward

(10) Patent No.: US 11,167,438 B2
(45) Date of Patent: Nov. 9, 2021

(54) ROOKIE RAZOR

(71) Applicant: Elizabeth Ward, Meridian, ID (US)

(72) Inventor: Elizabeth Ward, Meridian, ID (US)

( * ) Notice: Subject to any disclaimer, the term of this patent is extended or adjusted under 35 U.S.C. 154(b) by 0 days.

(21) Appl. No.: 16/407,034

(22) Filed: May 8, 2019

(65) Prior Publication Data

US 2020/0061860 A1 Feb. 27, 2020

Related U.S. Application Data

(60) Provisional application No. 62/721,610, filed on Aug. 23, 2018.

(51) Int. Cl.

| | |
|---|---|
| ***B26B 21/40*** | (2006.01) |
| ***B26B 21/52*** | (2006.01) |
| ***B26B 21/22*** | (2006.01) |

(52) U.S. Cl.

CPC ..... *B26B 21/4031* (2013.01); *B26B 21/222* (2013.01); *B26B 21/522* (2013.01)

(58) Field of Classification Search

CPC ..... B26B 21/00; B26B 21/16; B26B 21/18; B26B 21/22; B26B 21/222; B26B 21/40; B26B 21/4031; B26B 21/52; B26B 21/522; B26B 21/523

USPC ..... 30/47–55, 526

See application file for complete search history.

(56) References Cited

U.S. PATENT DOCUMENTS

| | | | | | |
|---|---|---|---|---|---|
| 843,148 | A * | 2/1907 | Jackson | B26B 21/24 | 30/47 |
| 1,108,839 | A * | 8/1914 | Foley | B26B 19/3813 | 30/55 |
| 1,415,077 | A * | 5/1922 | Williamson | B26B 21/16 | 30/51 |
| 1,726,570 | A * | 9/1929 | Keene | B26B 21/28 | 30/49 |
| 2,018,304 | A * | 10/1935 | Hayhurst | B26B 21/16 | 30/51 |
| 2,139,680 | A * | 12/1938 | Heinrich | B26B 21/16 | 30/49 |
| 2,192,362 | A * | 3/1940 | Merlo | B26B 21/08 | 30/53 |
| 2,501,987 | A * | 3/1950 | Brown | B26B 21/06 | 30/49 |
| 2,741,028 | A * | 4/1956 | Carter | B26B 5/006 | 30/53 |
| 2,746,147 | A * | 5/1956 | Booth | B26B 5/00 | 30/53 |
| 2,861,339 | A * | 11/1958 | Malecki | B26B 21/40 | 30/55 |
| 2,866,984 | A * | 1/1959 | Plough | B26B 21/12 | 30/53 |
| 3,109,237 | A * | 11/1963 | Girouard | B26B 21/00 | 30/49 |
| 3,488,764 | A * | 1/1970 | Welsh | B26B 21/06 | 30/50 |
| 3,660,893 | A * | 5/1972 | Welsh | B26B 21/54 | 30/50 |

(Continued)

*Primary Examiner* — Jason Daniel Prone

(57) ABSTRACT

Embodiments of a razor for shaving are disclosed. The razor may include a water-resistant handle. The razor may also include a blade with at least one sharp edge and one edge substantially enclosed substantially by handle. The razor may also include a blade with a plurality of edges that are interchangeable and each edge of blade may vary in sharpness.

7 Claims, 3 Drawing Sheets

(56) References Cited

U.S. PATENT DOCUMENTS 3,703,765 A * 11/1972 Perez ..... B26B 21/446 30/41
D231,583 S * 4/1974 De Lorenzo ..... D28/46
3,858,315 A * 1/1975 Ferraro ..... B26B 21/22 30/50
3,863,340 A * 2/1975 Perry ..... B26B 21/22 30/50
4,044,463 A * 8/1977 Tietjens ..... B26B 21/38 30/50
4,125,939 A * 11/1978 Brothers ..... B26B 21/22 30/50
4,272,886 A * 6/1981 Asano ..... B26B 21/52 30/47
4,335,509 A * 6/1982 Smith ..... B26B 21/28 30/48
4,346,721 A * 8/1982 Molaro ..... B26B 21/12 132/313
4,461,078 A * 7/1984 Carreker ..... B26B 21/40 30/47
4,562,645 A * 1/1986 Dato ..... B26B 21/4068 30/47
4,712,300 A * 12/1987 Hemmeter ..... B26B 21/40 30/41
4,782,590 A * 11/1988 Pope ..... B26B 21/00 30/49
4,845,848 A * 7/1989 Strickland ..... B26B 21/40 30/49
4,961,262 A * 10/1990 Lawrence ..... B26B 21/00 30/49
4,964,214 A * 10/1990 Welsh ..... B26B 21/40 30/49
4,979,298 A * 12/1990 Pesiri ..... B26B 21/56 30/49
4,984,365 A * 1/1991 Leonard ..... B26B 21/00 D28/46
5,029,390 A * 7/1991 Reeves ..... B26B 21/40 30/47
5,038,472 A * 8/1991 Iderosa ..... B26B 21/521 30/52
5,174,028 A * 12/1992 Seltzer, Jr. ..... B26B 5/005 30/329
5,208,984 A * 5/1993 Negus ..... B26B 5/006 30/329
5,220,728 A * 6/1993 Ueno ..... B26B 21/12 30/53
5,274,922 A * 1/1994 Elliott ..... B26B 21/06 30/47
5,461,782 A * 10/1995 Rauch ..... B26B 21/44 30/51
5,490,331 A * 2/1996 Gold ..... B26B 5/001 30/162
D371,221 S * 6/1996 Attaway ..... D28/46
5,524,346 A * 6/1996 Backhaus ..... B26B 21/222 30/50
5,692,529 A * 12/1997 Fekete ..... B26B 21/52 30/526
5,778,535 A * 7/1998 Ledesma ..... B26B 21/22 30/50
5,784,785 A * 7/1998 Polites ..... B26B 21/10 30/53
6,082,007 A * 7/2000 Andrews ..... B26B 21/00 30/47
D431,095 S * 9/2000 Hyman ..... D28/46
6,249,973 B1 * 6/2001 Hirano ..... B26B 21/12 30/54
6,473,971 B2 * 11/2002 Ordaz ..... B26B 21/08 30/47
6,701,619 B2 * 3/2004 Haruyuki ..... B26B 21/10 30/47
D500,172 S * 12/2004 Fields ..... D28/46
6,848,185 B2 * 2/2005 Tebo ..... B26B 9/02 30/162
7,171,752 B2 * 2/2007 Lee ..... B26B 21/12 30/53
8,099,871 B2 * 1/2012 Bilenski ..... B26B 5/005 30/329
8,141,258 B1 * 3/2012 Frisch ..... B26B 21/527 30/526
8,881,406 B2 * 11/2014 Glezerman ..... B26B 21/222 30/49
9,108,329 B2 * 8/2015 Stiles ..... B26B 21/22
2002/0062568 A1 * 5/2002 Stiles ..... B26B 21/522 30/526
2007/0062043 A1 * 3/2007 Marut ..... B26B 21/523 30/50
2008/0104847 A1 * 5/2008 Veras ..... B26B 21/56 30/49
2008/0115735 A1 * 5/2008 Wang ..... A01K 13/002 30/50
2009/0000123 A1 * 1/2009 Trezon ..... B26B 21/40 30/34.1
2009/0025234 A1 * 1/2009 Carlucci ..... B26B 19/042 30/527
2010/0175261 A1 * 7/2010 Lax ..... B26B 21/58 30/50
2013/0276311 A1 * 10/2013 Clemons ..... B26B 21/06 30/50
2016/0151925 A1 * 6/2016 Gers-Barlag ..... B26B 21/522 30/526

* cited by examiner

ROOKIE RAZOR

CROSS-REFERENCE TO RELATED APPLICATIONS

This application, under 35 U.S.C. § 119, claims the benefit of U.S. Provisional Patent Application Ser. No. 62/721,610 filed on Aug. 23, 2018, and entitled "Rookie Razor," the contents of which are hereby incorporated by reference herein.

FIELD OF THE DISCLOSURE

The present disclosure relates generally to a razor for shaving. More specifically, the present disclosure relates to a device for individuals inexperienced with shaving techniques to safely shave using a soft and malleable handle providing a non-slip grip and a protruding blade which is angled to maximize safety when shaving.

BACKGROUND

Razors are useful for shaving hair and the like from a variety of places. For example, razors are often used to shave hair from multiple areas of the human body but are generally oriented for adult use and can be dangerous, frightening, or otherwise intimidating to the inexperienced shaver. For example, existing razors typically involve multiple blades that simultaneously contact the skin while shaving or comprise a single blade that can be significantly difficult to use for the inexperienced shaver.

Another issue with existing systems is that blades accompanying a razor often come with one, preselected sharpness manufactured specifically for that razor. Thus, there is often no way to change the sharpness of the razor.

Another issue with existing systems is that razors are typically made with handles that are stiff and often inflexible. Such razors thus present significant risk to inexperienced individuals and present susceptibility to incised wounds, life lasting scars, and skin defects. Other drawbacks, issues, and inconveniences of existing systems also exist.

SUMMARY

The presently disclosed embodiments address the above-noted, and other, drawbacks, inconveniences, and issues with existing devices and methods.

It has been recognized that it would be advantageous to develop a shaving apparatus that can be used by inexperienced individuals to safely shave hair from their body, and that is simpler and less intimidating than other razors or shaving devices.

Viewed from a first aspect, the present innovation may comprise a razor for shaving comprising a water resistant, substantially flexible handle that comprises a top end and a bottom end. The handle further comprises an opening that extends substantially horizontally along the bottom end; a blade comprising at least one sharp edge and at least one substantially enclosed edge that is substantially enclosed by the handle.

In some embodiments, the handle of the razor may be made of biodegradable material. Biodegradable material is a substance, composition of matter, or the like capable of being decomposed by bacteria or other living organisms. Some examples of biodegradable material include plant products, wood, paper, food waste, leaves, grasses, or the like. Another example may be a biodegradable plastic made from plants, cellulose, protein, chitin, bacteria, starch, soy, sugar cane, or other natural and renewable resources such as corn, wheat or potatoes.

In another embodiment, the handle may be made of recyclable material. Recyclable material is a substance, composition of matter, or the like that can be reused, reprocessed, recovered, or the like. Some examples may include bottles, bags, packaging, plastics, polymers, steel, tin, aluminum, glass, paperboard, paper or the like.

In another embodiment, the handle of the razor may be substantially flexible, malleable, bendable, or the like. For example, the substantial flexibility of the handle may permit an inexperienced shaver to flex the handle while shaving at difficult angles around the face, legs, or other areas of the body presenting challenging angles. In the example above, the handle's substantial flexibility may help an inexperienced shaver avoid incisions, cuts, or other abrasions of the skin.

In another embodiment, the handle may be perceptively identifiable with the inclusion of color variations, symbols, numbers, letters, notches, or the like. For example, this could make the razor easily identifiable when multiple individuals of the same household use the same type of razor. The perceptible identifier may allow a male and female to distinguish between each other's razors, as yet another example.

In another embodiment, the razor may comprise a blade with a sharp edge protruding from the opening of the handle. The blade may have multiple interchangeable edges that vary in degree of sharpness allowing for edge selectivity. For example, the less sharp edges may be used by a less experienced shaver, thus increasing safety when learning how to shave or shaving for the first time. Additionally, more experienced shavers may use more progressive, sharper blades for a shave that gets closer to the hair follicle, producing a cleaner shave.

In another embodiment, the edges of the blade may be perceptively identifiable by color variations, symbols, numbers, letters, notches, or the like. For example, perceptual identifiers will enable an individual to easily select an edge that matches their shaving preferences, such as shaving skill-sets, shaving experience, and desired edge sharpness.

In another embodiment, the blade may have at least one sharp edge protruding from the opening of the handle at a perpendicular angle. As one example, the at least one sharp edge of the blade may protrude at an angle ranging from approximately 45 degrees to 180 degrees.

In another embodiment, the blade may be made of plastic. Some examples of plastics may be characterized as including, polyamides, polycarbonate, polyester, polyethylene, high-density polyethylene, low-density polyethylene, polyethylene terephthalate, polypropylene, polystyrene, polyurethanes, polyvinyl chloride, polyvinylidene chloride, acrylonitrile butadiene styrene, or the like. Other advantages, conveniences, and embodiments are apparent to those of ordinary skill in the art having the benefit of this disclosure.

Figure 1:
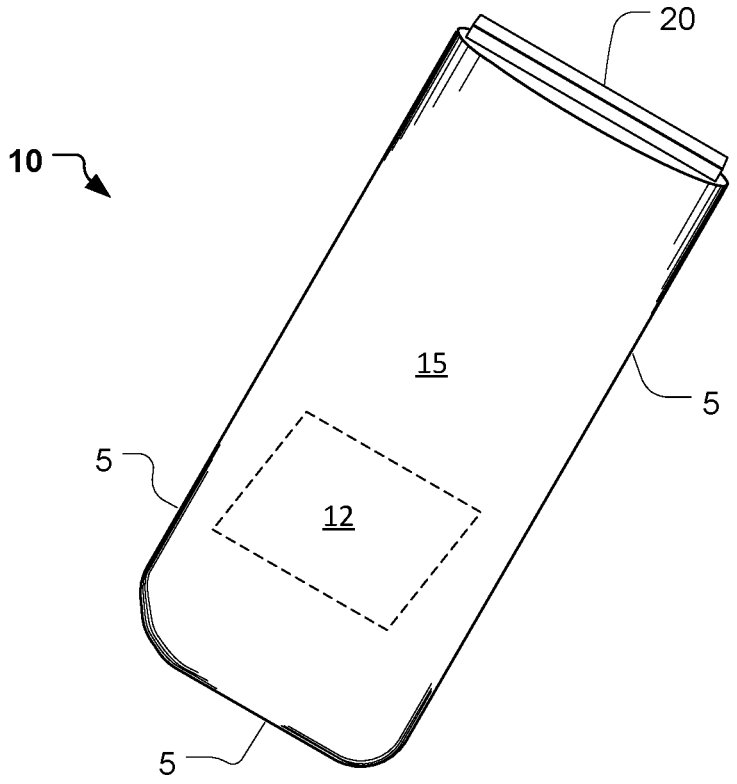
FIG. 1 is a representative isometric view of a razor according to disclosed embodiments.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

It should also be understood that, as used herein, the terms "vertical," "horizontal," "lateral," "upper," "lower," "left," "right," "inner," "outer," etc., can refer to relative directions or positions of features in the disclosed devices and/or assemblies shown in the Figures. For example, "upper" or "uppermost" can refer to a feature positioned closer to the top of a page than another feature. These terms, however, should be construed broadly to include devices and/or assemblies having other orientations, such as inverted or inclined orientations where top/bottom, over/under, above/below, up/down, and left/right can be interchanged depending on the orientation.

FIG. 1 is an isometric view of embodiments of the razor 10 in accordance with the disclosure. As shown, the razor 10 may comprise a water-resistant, substantially flexible handle 15 and may comprise at least one blade 20. The handle 15 may be formed of any sustainable biodegradable material such as plant species, woods, food wastes, or the like. In another embodiment, the handle 15 may also be formed of any sustainable recyclable material such as plastic bottles, packaging, plastics, polymers, or the like. The handle 15 may be formed of water-resistant material making the handle 15 easy to grasp without movement, sliding, slipping or the like. The handle's 15 water-resistance may be increased by application of a water-resistant coating such as nail polish, rubber, polyvinyl chloride, polyurethane, silicone, elastomer, fluoropolymers, wax or the like.

As shown in FIG. 1, the handle 15 may be generally rectangular having curved edges 5 to provide more comfort for holding. Other shapes may also be used. The handle 15 may be bendable, malleable, flexible or the like. The handle's 15 flexible nature allows hair to be shaved from areas presenting angular surfaces, such as a face or legs, while avoiding cuts, incisions, abrasions, nicks, scrapes or the like. In some embodiments, the handle 15 may be perceptively identifiable with the inclusion of color variations, symbols, numbers, letters, notches, or the like, as exemplarily illustrated at marker 12. This may be advantageous for distinguishing ownership of a razor 10 when cohabitating with multiple people owning the same type of razor 10.

Figure 4:
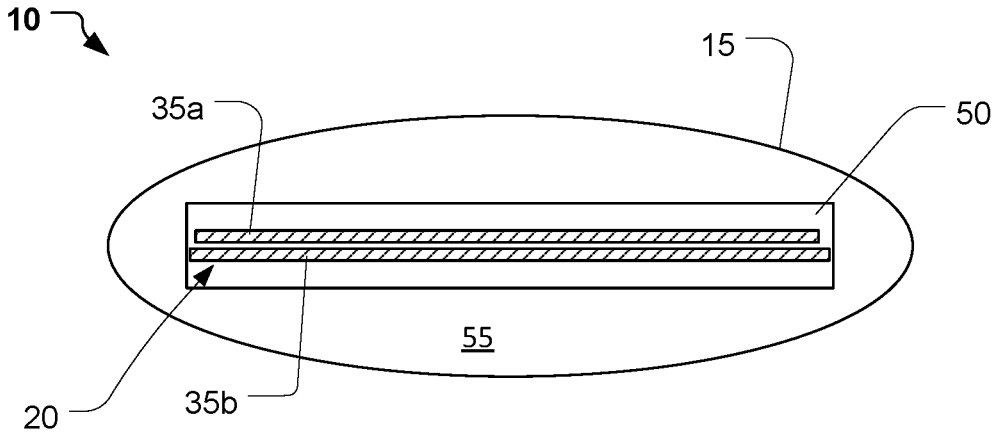
FIG. 4 is a representative front side view of a razor according to disclosed embodiments.

FIG. 4 is a front view of embodiments of the razor 10 in accordance with the disclosure. As shown, the handle 15 may comprise an opening 50 extending substantially along the width of the front end 55. The opening 50 may facilitate the installation, replacement, interchangeability, or the like of at least one blade (collectively indicated at 20) which may have a plurality of interchangeable sharp edges 35*a*-35*b*. In some embodiments one blade 20 may have an edge 35*a* that is more or less sharp than an edge 35*b* of the other blade 20. Each blade 20 may be made of any sustainable plastic such as polycarbonate, polyethylene, high-density polyethylene, polyethylene terephthalate, polyvinyl chloride, polyoxymethylene, acrylonitrile butadiene styrene or the like.

Figure 7:
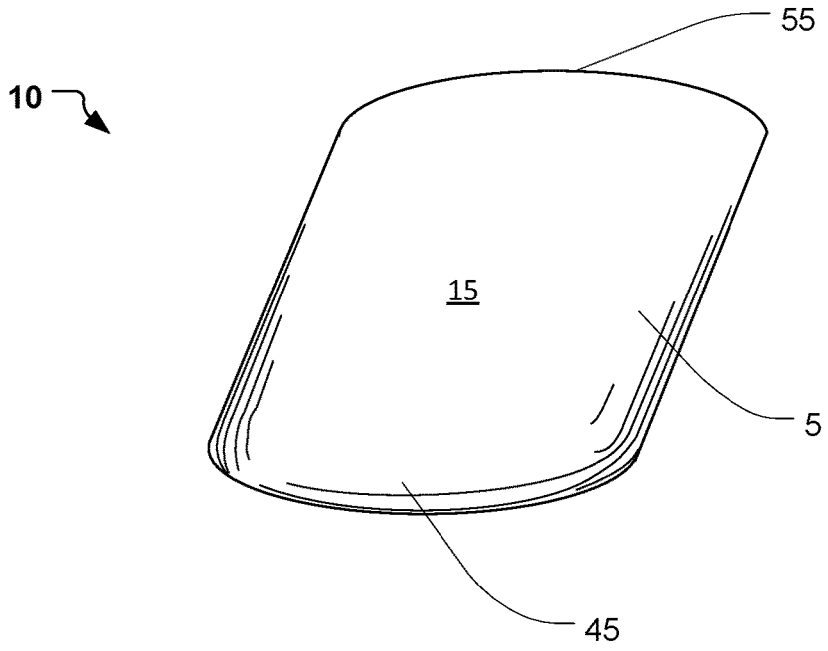
FIG. 7 is a representative isometric rear view of a razor according to disclosed embodiments.

FIG. 7 is a rear view of embodiments of the razer 10 in accordance with the disclosure. As shown in this view, the handle 15 may comprise a rounded, closed end 45 that is longitudinally opposite of an open end 50. The closed end 45 may be other shapes as well. The handle's 15 closed end 45 provides stability of the blade 20 and comfort and safety when gripping the razor 10.

Figure 2:
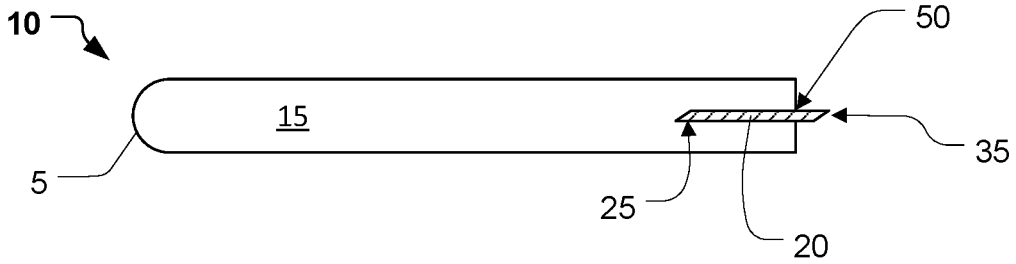
FIG. 2 is a representative cross-sectional right side view of a razor according to disclosed embodiments.
Figure 3:
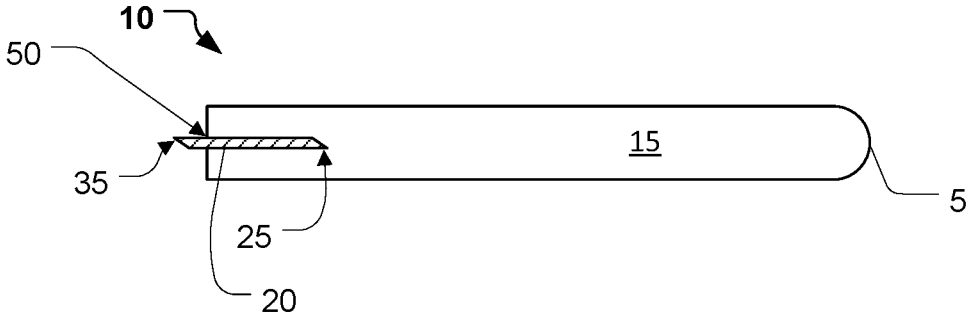
FIG. 3 is a representative cross-sectional left side view of a razor according to disclosed embodiments.

FIGS. 2 and 3 are cross-sectional side views, with at least one sharp edge 35 of the blade 20 protruding, of embodiments of the razor 10 in accordance with the disclosure. As shown, razor 10 may further comprise a blade 20 with at least one retaining edge 25 substantially enclosed substantially by handle 15 and at least one sharp edge 35 protruding from an opening 50 of the handle 15. At least one sharp edge 35 may protrude from an opening 50 of the handle 15 at a perpendicular angle. An example of a perpendicular angle at least one sharp edge 35 may protrude from the opening 50 of the handle 15 may range from approximately 45 degrees to 180 degrees.

Figure 5:
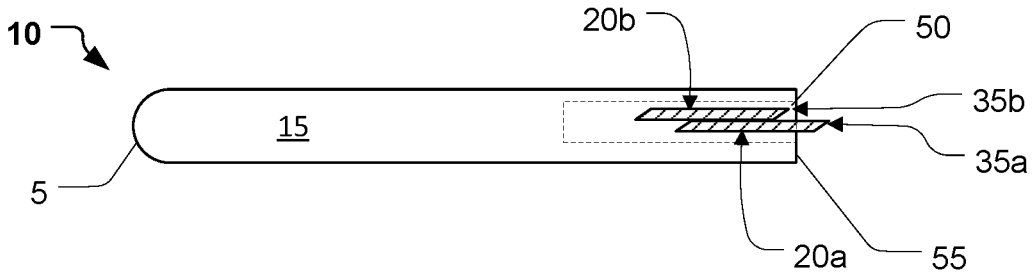
FIG. 5 is a representative right cross-sectional view of a razor according to disclosed embodiments.
Figure 6:
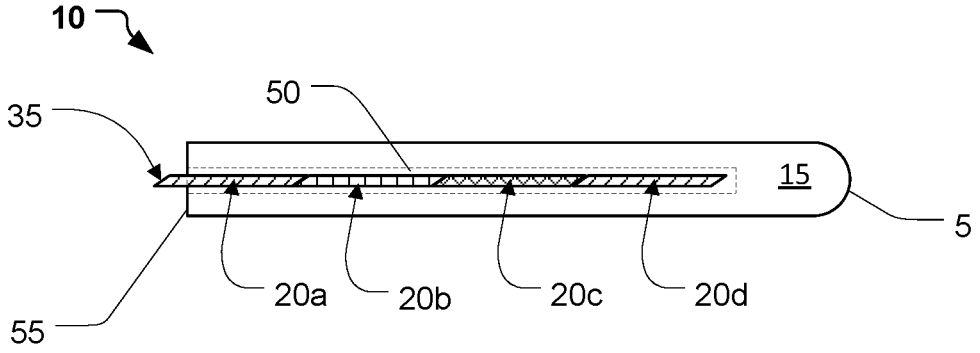
FIG. 6 is a representative left cross-sectional view of a razor according to disclosed embodiments.

FIGS. 5 and 6 are a cross-sectional side views of embodiments of the razor 10 in accordance with the disclosure. As shown, a blade 20 is substantially enclosed by the handle 15. The blade 20 may have a plurality of interchangeable edges 35*a*-35*b* (in FIG. 5) which may provide varying and progressive sharpness options. FIG. 5 illustrates an embodiment of the razor 10 with a "stacked" configuration of blades 20*a*-20*b* with one blade (20*b*) on top of the other (20*a*). FIG. 5 illustrates the opening 50 being closer to one handle side than to the other handle side. One of the other of the blades 20*a*-20*b* may be pulled or pushed into shaving position (with sharp edge 35*a*, 35*b* outside of opening 50) by a button, lever, or the like (not shown).

As illustrated in FIG. 6, other embodiments may have at least one sharp edge 35 of the blade 20 protruding from an open end 50 of the handle 15 while a plurality of other interchangeable blades 20*a*-20*d* remain enclosed within the handle 15. Again, the blades 20*a*-20*d* may be pulled or pushed into shaving position (with sharp edge 35 outside of opening 50) by a button, lever, or the like (not shown). It is also possible that individual ones of the blades 20*a*-20*d* may be snapped off and discarded after use. Interchanging of blades 20*a*-20*d* allows selectivity of desired edge sharpness when shaving. Further, the implementation of a single sharp edge 35 is different than conventional razor blades which often have multiple blades that will simultaneously contact the skin at all times while shaving, thus providing no option for blade selectivity. In some embodiments, sharpness of the blade's 20 edges 35 may be perceptively identifiable with the inclusion of color variations, symbols, numbers, letters, notches, or the like (schematically indicated in FIG. 6 by different cross hatchings indicating perceptible indicia of blade type). This may be advantageous to an inexperienced shaver who may want to learn to shave with a less sharp edge or an experienced shaver who may prefer a sharper edge.

As shown in FIGS. 5 and 6, the blade 20 may have one sharp edge 35 that protrudes from the opening 50 of the handle 15. However, other embodiments of the blade 20 also exist, such as a blade 20 with a plurality of sharp edge's protruding from the opening 50 of the handle 15, but still arranged to provide an option for only one sharp edge 35 being protruded at any time.

Figure 8:
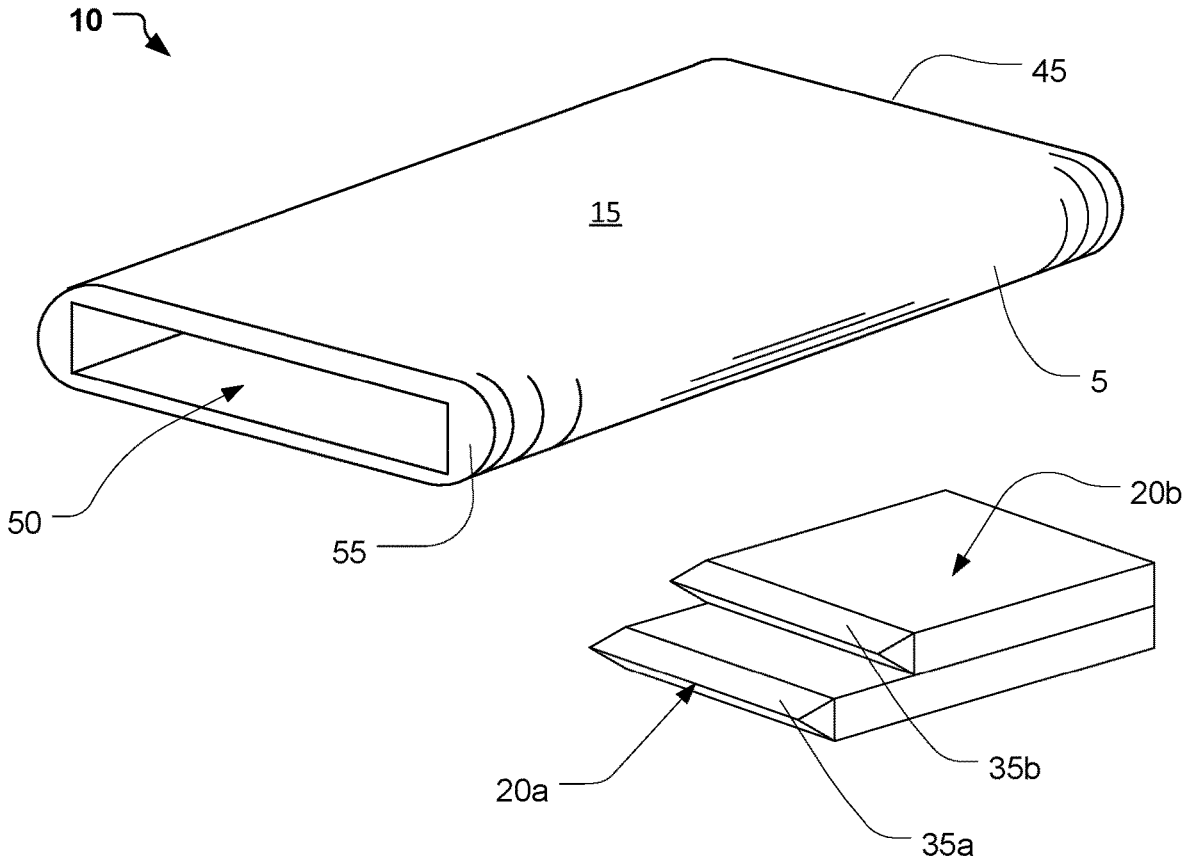
FIG. 8 is a representative exploded isometric side view of a razor according to disclosed embodiments.

FIG. 8 is an exploded side view of embodiments of the razor 10 in accordance with the disclosure. For illustrative purposes, the blades 20*a*-20*b* shown in FIG. 8 have at least one sharp edge 35*a*, 35*b* extending longitudinally. As shown in FIG. 8, one of the edges (e.g., 35*b*) is retracted in the longitudinally opposite direction of the at least one extended sharp edge 35*a* to depict an embodiment which may include a blade 20 having interchangeable edges 35*a*, 35*b* which may have varying degrees of sharpness. This blade 20 is different than conventional razor blades which come with a preselected sharpness. The interchangeability and selectivity of edge sharpness may provide inexperienced shavers with a blade less likely to damage the skin or induce cuts, nicks, incisions, or the like.

Although various embodiments have been shown and described, the present disclosure is not so limited and will be understood to include all such modifications and variations would be apparent to one skilled in the art.

What is claimed is:

1. A razor for shaving comprising: a substantially rectangular handle including a first side and an opposing second side and a first end and an opposing second end connecting the first side and the second side, an opening in the second end, the opening is closer to one of the handle sides than to the other of the handle sides; a first blade with a first cutting edge and a second blade with a second cutting edge extending in the same direction as the first cutting edge, the blades are in the opening, and the second blade engages the first blade to define an offset stacked blade configuration so that the first cutting edge extends out of the opening while the second blade along with the second cutting edge is completely within the opening.

2. The razor according to claim 1, wherein the handle is made of biodegradable material or a recyclable material.

3. The razor according to claim 1, wherein at least one of the first and second sides is configured to provide a non-slip grip.

4. The razor according to claim 1, wherein the first cutting edge has a different sharpness than the second cutting edge.

5. The razor according to claim 1, wherein the handle is water resistant and is configured to be substantially flexible, malleable, or bendable.

6. The razor according to claim 1, wherein the opening is configured to facilitate installation, replacement, or interchangeability of the blades.

7. The razor according to claim 1, wherein at least one of the blades is plastic.

* * * * *